US012654281B2

(12) United States Patent
Heyoung et al.

(10) Patent No.: US 12,654,281 B2
(45) Date of Patent: Jun. 16, 2026

(54) POLISHING DEVICE FOR DELAYERING

(71) Applicant: INTEC CORPORATION CO., LTD., Gyeonggi-do (KR)

(72) Inventors: Heyoung Cheol Heyoung, Gyeonggi-do (KR); Tae Sun Back, Gyeonggi-do (KR); Yong Kim, Gyeonggi-do (KR)

(73) Assignees: INTEC CORPORATION CO., LTD., Gyeonggi-do (KR); Heyoung Cheol Heyoung, Gyeonggi-do (KR); Tae Sun Back, Gyeonggi-do (KR)

( * ) Notice: Subject to any disclaimer, the term of this patent is extended or adjusted under 35 U.S.C. 154(b) by 368 days.

(21) Appl. No.: 18/290,330

(22) PCT Filed: Dec. 16, 2022

(86) PCT No.: PCT/KR2022/020589
§ 371 (c)(1),
(2) Date: Nov. 13, 2023

(87) PCT Pub. No.: WO2023/121152
PCT Pub. Date: Jun. 29, 2023

(65) Prior Publication Data

US 2024/0246194 A1 Jul. 25, 2024

(30) Foreign Application Priority Data

Dec. 20, 2021 (KR) ..... 10-2021-0182715

(51) Int. Cl.
*B24B 41/06* (2012.01)
*B24B 7/04* (2006.01)
*B24B 37/24* (2012.01)

(52) U.S. Cl.
CPC ..... *B24B 41/06* (2013.01); *B24B 7/04* (2013.01); *B24B 37/24* (2013.01)

(58) Field of Classification Search
CPC ..... B24B 7/228; B24B 37/005; B24B 37/04; B24B 37/042; B24B 37/07; B24B 37/08; B24B 37/10; B24B 37/102; B24B 37/105; B24B 37/27; B24B 37/28; B24B 37/30; B24B 37/34; B24B 37/345
See application file for complete search history.

(56) References Cited

U.S. PATENT DOCUMENTS 4,603,867 A * 8/1986 Babb ..... B23B 31/307 451/388
5,711,196 A * 1/1998 Reid ..... B24B 41/067 451/384
6,030,282 A * 2/2000 Mahanpour ..... B24B 7/228 451/364

(Continued)

*Primary Examiner* — Joel D Crandall
(74) *Attorney, Agent, or Firm* — IPLA P.A.

(57) ABSTRACT

A polishing device for delayering includes: a stage which is installed to move along the X-axis and the Y-axis, and is rotatable about its own axis; a holder installed above the stage and supporting an object mounted on the upper surface thereof; and a grinder unit installed to be movable above the holder and having a polishing pad on one surface thereof corresponding to the object. The holder includes a rotating plate, a fixing unit installed on one side of an inner wall of the rotating plate, and horizontal correction rings that protrudes upward from an upper surface of the rotating plate.

4 Claims, 6 Drawing Sheets

(56) References Cited

U.S. PATENT DOCUMENTS

| | | | | |
|---|---|---|---|---|
| 6,485,361 | B1 * | 11/2002 | Mahanpour | B24B 41/06<br>451/364 |
| 6,513,796 | B2 * | 2/2003 | Leidy | B25B 11/005<br>269/21 |
| 7,004,827 | B1 * | 2/2006 | Suzuki | B24B 37/28<br>451/286 |
| 2006/0099886 | A1 * | 5/2006 | Rubin | B24B 37/005<br>451/6 |
| 2014/0076500 | A1 * | 3/2014 | Honda | B32B 43/006<br>156/750 |
| 2014/0150981 | A1 * | 6/2014 | Itou | H01L 21/67132<br>156/714 |

* cited by examiner

POLISHING DEVICE FOR DELAYERING

BACKGROUND

The present invention relates to a polishing device for delayering, and, more specifically, to a polishing device for delayering in that the polishing area of the object can be easily identified only by moving the grinder unit up by a predetermined interval in the process of performing an operation of polishing the object, so that it can greatly improve the work efficiency and remarkably reduce the working time required for the polishing operation.

In the semiconductor industry, a delayering operation is performed by repeatedly grinding an object to a certain thickness and monitoring and analyzing its cross-section to check the quality of semiconductors during the manufacturing process or to trace a cause of a problem when the problem occurs in the finished product.

At this time, either a chemical polishing method or a physical polishing method can be used to polish the object, and the physical polishing method with high polishing efficiency is mainly used.

Conventionally, the workers performed the grinding work on the object using a grinding tool while the object was fixed using a separate jig. However, there are problems in that that the results vary significantly depending on the operator's skill level and the polishing work takes a considerable amount of time due to the manual work.

Accordingly, efforts have been made to polish the delayering object using a polishing device for semiconductor manufacturing.

FIG. 1 is a diagram schematically showing a polishing device for semiconductor manufacturing.

As shown in FIG. 1, the polishing device (100) for semiconductor manufacturing generally includes a polishing plate (110) which is rotatably installed in the installation target area, wherein a wafer to be polished is placed on one side of the upper surface thereof; an abrasive agent supply unit (120) for supplying the abrasive agent which is formed on the upper surface of the polishing plate (110); and a head unit (130) that can move up and down on the polishing plate {110} and presses the wafer downward when it moves downward.

Accordingly, while the head unit (130) presses the wafer downward, the polishing plate (110) rotates to polish the bottom surface of the wafer.

However, when using the device to polish the object for delayering, the bottom surface of the object is polished. At this time, in order to monitor the cross section thereof, the polishing operation must be stopped and the object must be checked after being pulled out from the device, which significantly reduces work efficiency thereof. In addition, there was a case where the process time increases compared to the manual work.

In addition, in the case of the delayering using the polishing device for semiconductor manufacturing, as described above, it is difficult to check the polished surface of the object, making it very difficult to precisely control the polishing thickness of the object.

SUMMARY OF THE INVENTION

Accordingly, the present invention has been made in an effort to solve the problems and an object of the present invention is to provide a polishing device for delayering in that the polishing area of the object can be easily identified only by moving the grinder unit up by a predetermined interval in the process of performing an operation of polishing the object, so that it can greatly improve the work efficiency and remarkably reduce the working time required for the polishing operation.

Another object of the present invention is to provide a polishing device for delayering that can precisely polish an object using a polishing pad made of a felt material or a fabric material.

Further another object of the present invention is to provide a polishing device for delayering that can make the polished surface of the object more flat by maintaining the level of a tool unit through a horizontal correction ring.

In order to achieve the objects, the present invention provides a polishing device for delayering including: a stage which is installed to move along the X-axis and the Y-axis, and is rotatable about its own axis; a holder installed above the stage and supporting an object mounted on an upper surface thereof; and a grinder unit installed to be movable above the holder and having a polishing pad on one surface thereof corresponding to the object, wherein the holder includes: a rotating plate which includes a seating groove with a depth lower than the height of the object formed on an upper surface thereof, is installed to move along the X-axis and the Y-axis in an installation target area, and is rotatable about its own axis; a fixing unit installed on one side of an inner wall of the rotating plate having the seating groove so as to fix the object by elastically pressing a side of the object when the object is seated in the seating groove; and a plurality of horizontal correction rings that protrudes upward from an upper surface of the rotating plate and forms a concentric circle with the seating groove.

In addition, it is preferred that the grinder unit includes a main body installed on the upper portion of the holder to be movable in a direction toward or away from the holder; and a tool unit made of a felt material or a fabric material, which is rotatably installed at a lower portion of the main body and grinds the object while rotating in contact with the object, when the main body approaches the holder.

In addition, it is preferred that the holder further includes a guide wall extending upward from an outer peripheral area of the rotating plate.

According to the present invention as described above, it is possible to easily identify the polishing area of the object only by moving the grinder unit up by a predetermined interval in the process of performing an operation of polishing the object. Therefore, the present invention has an effect in that it can greatly improve the work efficiency and remarkably reduce the working time required for the polishing operation.

In addition, the present invention has an effect of precisely polishing the object using a polishing pad made of felt or cloth.

In addition, the present invention has an effect of making the polished surface of the object more flat by maintaining the level of the tool unit through the horizontal correction ring.

BRIEF DESCRIPTION OF DRAWINGS

The above and other objects, features and advantages of the present invention will be more apparent from the following detailed description taken in conjunction with the accompanying drawings, in which.

DETAILED DESCRIPTION OF THE INVENTION

Hereinafter, a preferred embodiment of the present invention will be described in detail with reference to the accompanying drawings.

Figure 1:
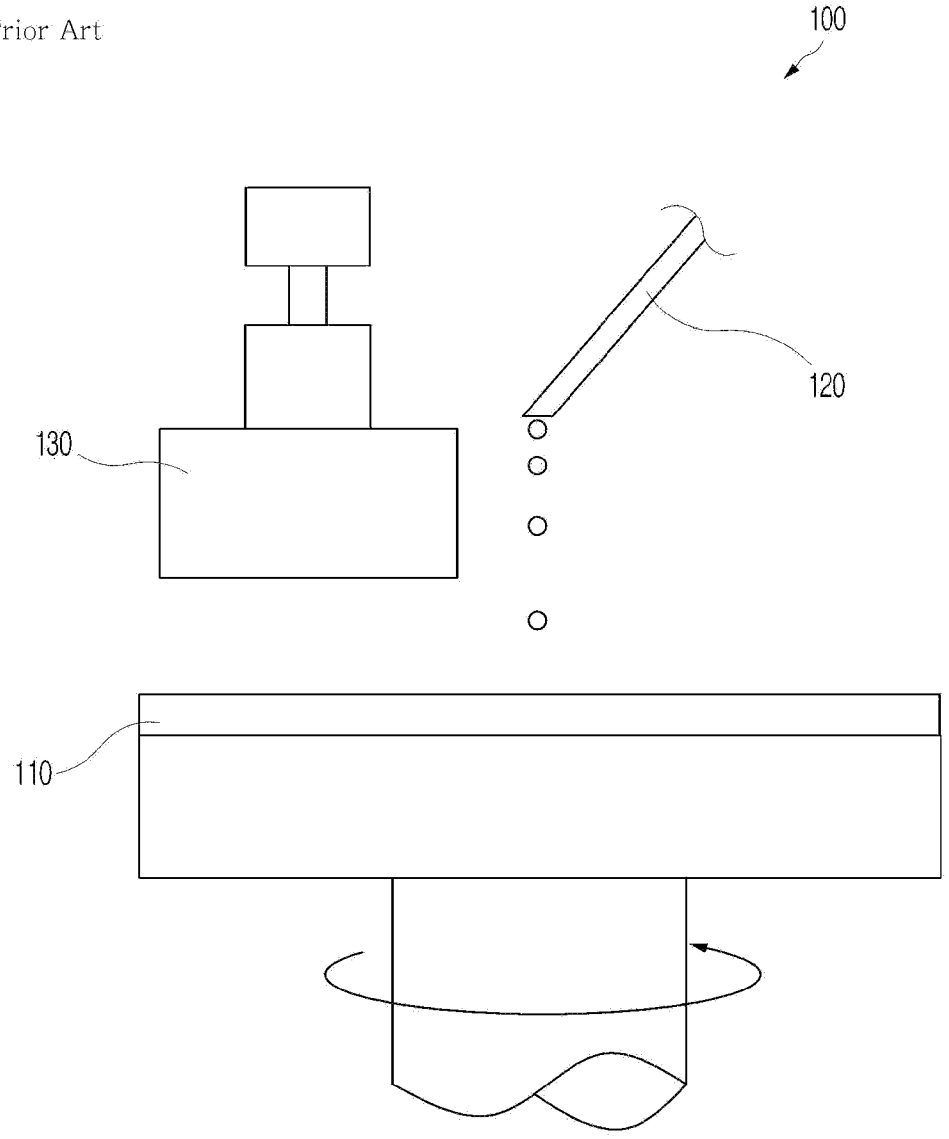
FIG. 1 Prior Art
FIG. 1 is a diagram schematically showing a polishing device for semiconductor manufacturing.
Figure 2:
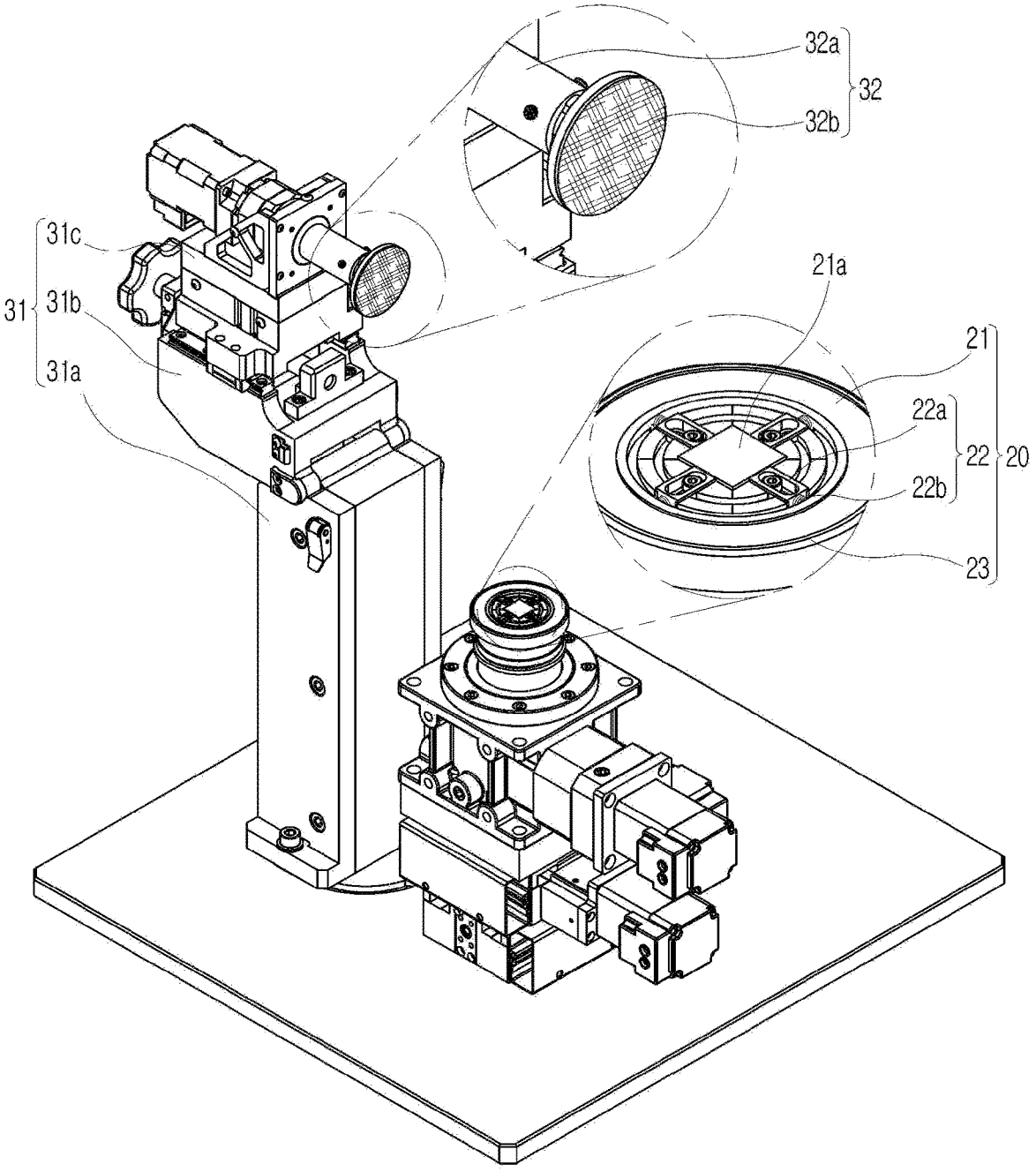
FIG. 2 is a perspective view of a polishing device for delayering according to an embodiment of the present invention.
Figure 3:
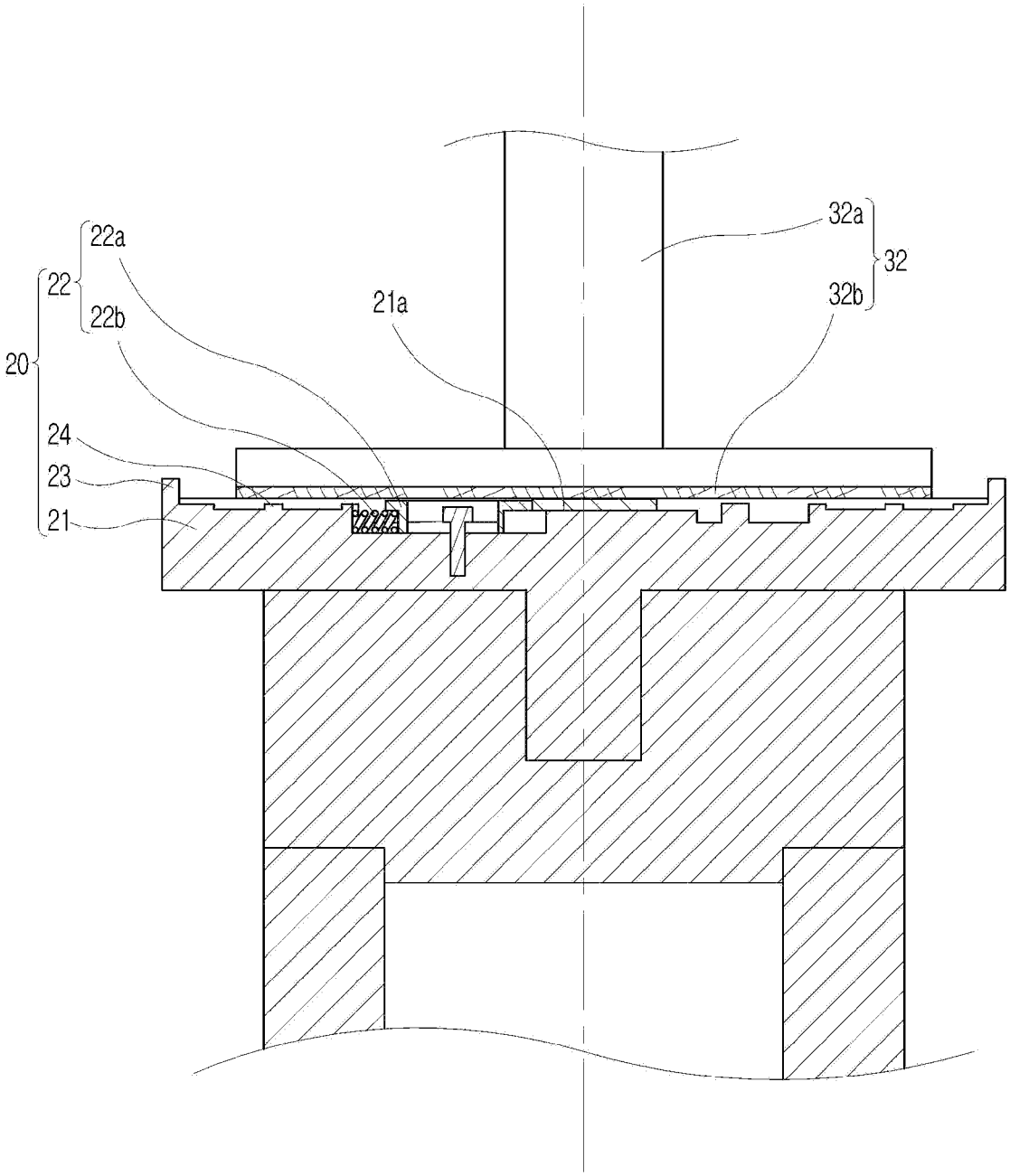
FIG. 3 is a cross-sectional view of a holder according to an embodiment of the present invention.

FIG. 2 is a perspective view of a polishing device for delayering according to an embodiment of the present invention, and FIG. 3 is a cross-sectional view of a holder according to an embodiment of the present invention.

As shown in FIG. 2 and FIG. 3, the polishing device (1) for delayering according to an embodiment of the present invention includes a stage (10), a holder (20), and a grinder unit (30).

The stage (10) is formed approximately in the shape of a plate, is installed to move along the X-axis and the Y-axis in the installation target area, and is rotatable about its own axis. Accordingly, when a polishing operation is performed on an object, the object fixed to the holder (20), which will be described later, is rotated and moved along the X-axis and the Y-axis by quickly moving it in at least one direction of the X-axis and the Y-axis to be vibrated and rotated at the same time.

This stage (10) serves to ensure that the object is polished uniformly overall by moving the object in a straight line and rotating it during the object polishing process.

The holder (20) includes a rotating plate (21) that is formed in a substantially disk shape, a fixing unit (22) that is installed in the inner area of the rotating plate (21), a guide wall (23) that extends upward from the outer peripheral area of the rotating plate (21), and a horizontal correction ring (24) that protrudes upward from an upper surface of the rotating plate (21).

The rotating plate (21) includes a downwardly recessed seating groove (21*a*) formed in the center thereof. The depth of the seating groove (21*a*) is formed to be lower than the height of the object, and serves to support the object by seating it on the upper surface thereof.

The fixing unit (22) includes a fixing block (22*a*) which is installed on one side of an inner surface of the rotating plate (21) having the seating groove (21*a*) to be movable in the inner and outer directions of the seating groove (21*a*) and an elastic member (22*b*) that is interposed between the inner surface of the rotating plate (21) and the fixing block (22*a*), provides an elastic force to the fixing block (22*a*) in the direction of the object, and server to fix the object by elastically pressing one side of the object seated in the seating groove (21*a*).

As described above, the guide wall (23) that extends upward from the outer peripheral portion of the rotating plate (21) to prevent the tool unit (32) from being separated from the rotating plate (21) during the polishing operation of the object, so that it plays a role in improving efficiency.

The plurality of horizontal correction rings (24) is formed at regular intervals with the center of the rotating plate (21) as a concentric circle. When polishing the object, it supports the bottom surface of the tool unit (32), which will be described later, and also guides the tool unit (32) to greatly increase the efficiency of flattening the polishing surface of the object.

The grinder unit (30) includes a main body (31) installed on an upper portion of the holder (20) and a tool unit (32) rotatably installed on a lower portion of the main body (31). It serves to grind the upper surface of the object while rotating, after contacting the object seated on the rotating plate (21).

The main body (31) includes a support (31*a*) which is fixed to the installation target area, a support block (31*b*) which is rotatably coupled to the upper portion of the support (31*a*), and a moving block (31*c*) which is movably installed on one side of the support block (31*b*) in the vertical direction.

This body (31) serves to support the tool unit (32) and provide a moving force thereto, so that the tool unit (32) can be moved in the vertical direction.

The tool unit (32) includes a body portion (32*a*) rotatably coupled to one side of the moving block (31*c*), and a polishing pad (32*b*) made of a felt material or a fabric material which is coupled to the lower portion of the body portion (32*a*) and placed on the upper portion of the holder (20).

Accordingly, when moved downward, it contacts the object seated on the holder (20) and serves to polish the object.

Here, since the polishing pad (32*b*) of this embodiment is made of felt or fabric material as described above, the polishing thickness of the object can be precisely controlled by finely polishing the object, so that the delayering can be performed efficiently.

Figure 4:
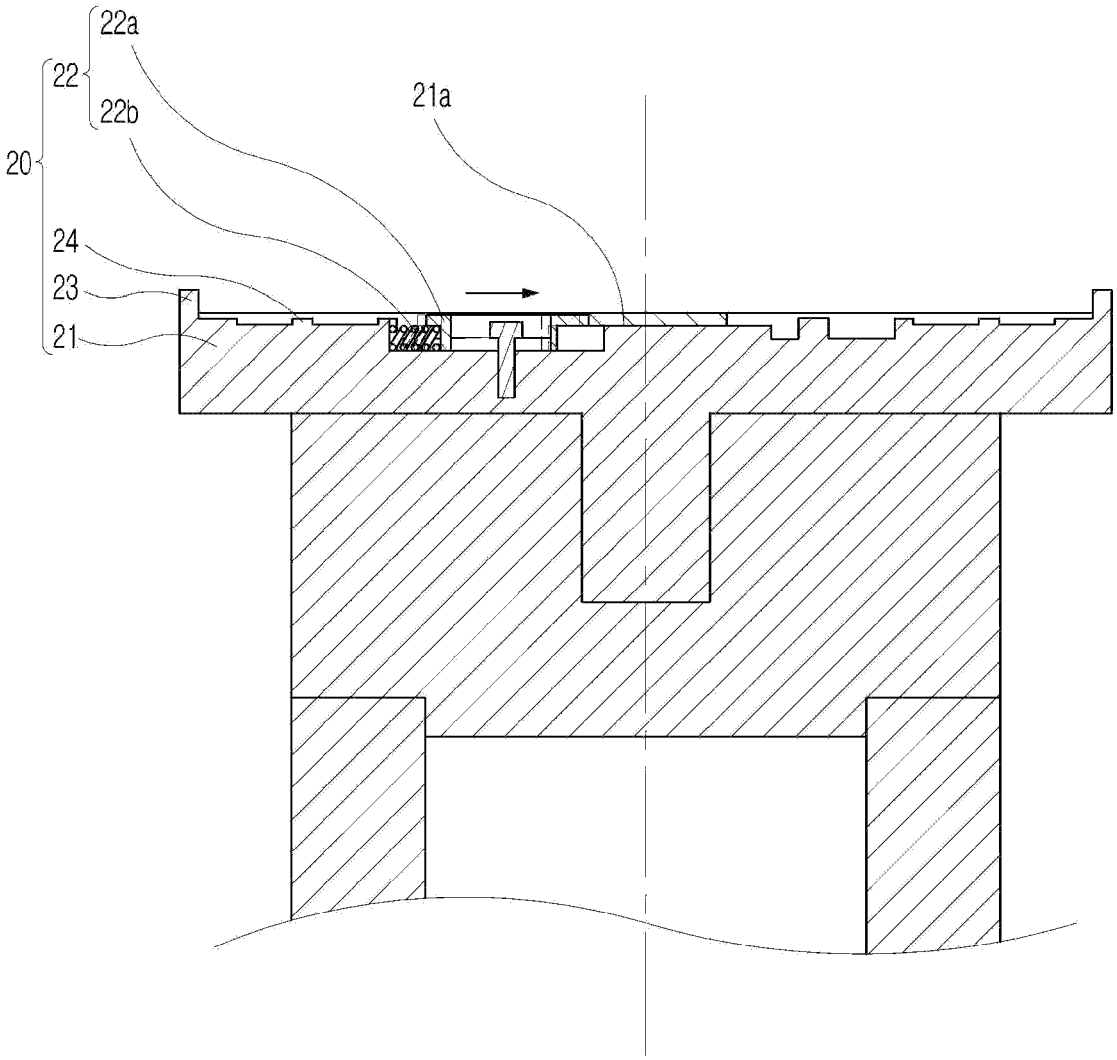
FIG. 4 is a diagram showing a state in which an object is fixed to a holder according to an embodiment of the present invention.
Figure 5:
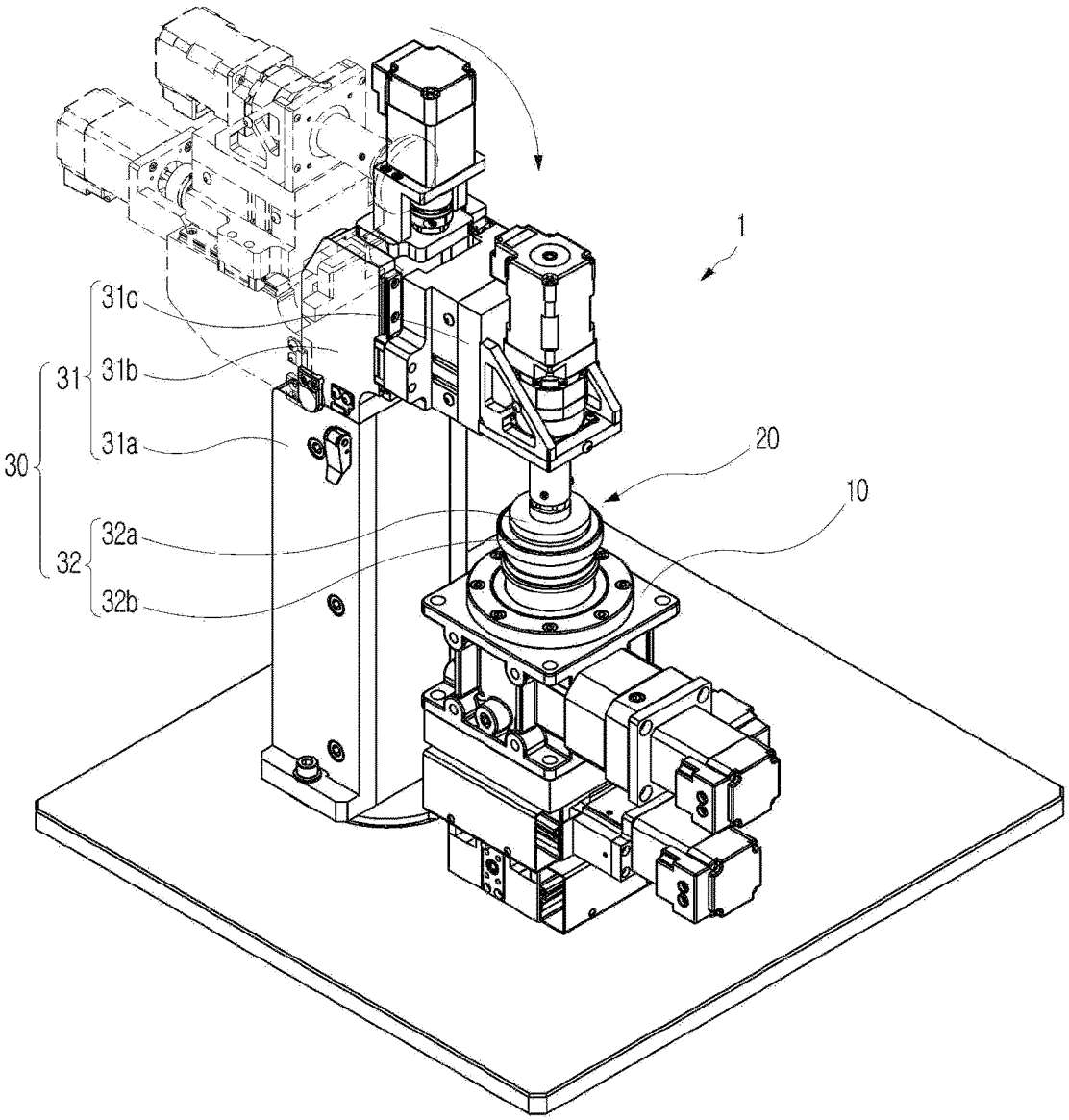
FIG. 5 is a diagram showing a state in which a tool unit is in contact with an object according to an embodiment of the present invention.
Figure 6:
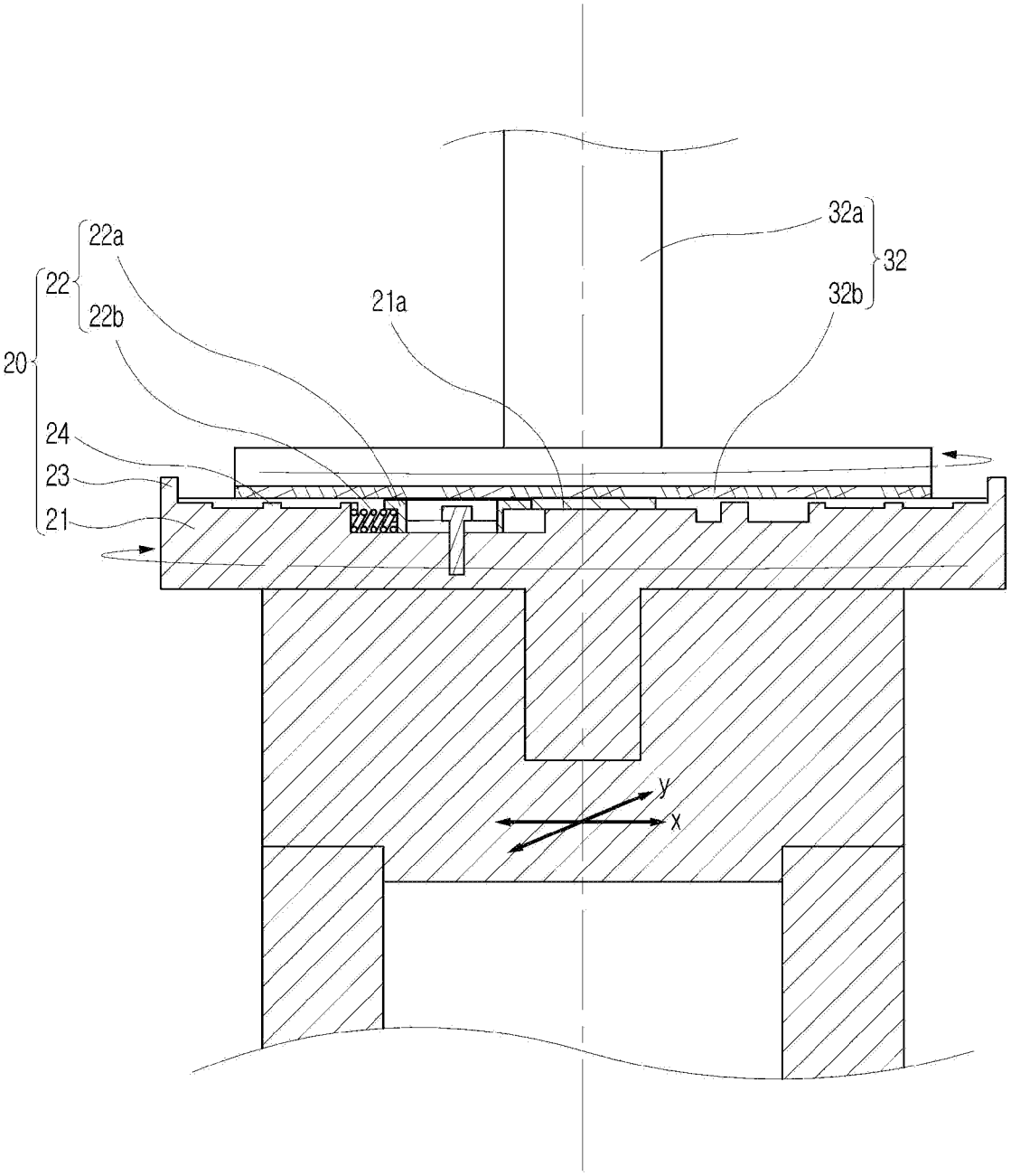
FIG. 6 is a diagram showing a state in which an object is polished according to an embodiment of the present invention.

FIG. 4 is a diagram showing a state in which an object is fixed to a holder according to an embodiment of the present invention, FIG. 5 is a diagram showing a state in which a tool unit is in contact with an object according to an embodiment of the present invention, and FIG. 6 is a diagram showing a state in which an object is polished according to an embodiment of the present invention.

The operation of the polishing device (1) for delayering according to an embodiment of the present invention having such a configuration will be described with reference to the attached FIG. 4 to FIG. 6 as follows.

First, the object to be delayered is placed in the seating groove (21*a*) of the rotating plate (21) of the holder (20) and the object is fixed using the fixing unit (22).

When the object is fixed thereto, the support block (31*b*) is rotated and the main body (31) is moved downward, so that the polishing pad (32*b*) is in contact with the object.

Afterwards, when the stage (10) and the tool unit (32) are driven, the stage (10) quickly reciprocates in at least one direction of the X-axis and the Y-axis to be vibrated and rotated at the same time, so that the object is moved together and the tool unit (32) rotates to polish the object.

At this time, the tool unit (32) is rotated with its bottom supported by the horizontal correction ring (24), thereby enabling stable rotation thereof. The polishing height thereof is determined by the horizontal correction ring (24), thereby allowing the object to be polished more flatly.

After grinding the object for a preset time in this way, the main body (31) is moved upward or the support block (31*b*)

is rotated to release the contact state between the tool unit (32) and the object, and then the polishing surface of the object is monitored. Afterwards, when the monitoring work of the relevant polishing surface is completed, the same operation as above is repeated to polish the object step by step, and the polishing surface of the object to be monitored is analyzed to perform and complete the delayering work.

Although the present invention has been described by way of limited embodiments and drawings, the present invention is not limited by this and various modifications and variations can be made by those skilled in the art to which the present invention pertains. Those of ordinary skill in the art related to this embodiment will understand that it may be implemented in a modified form without departing from the essential characteristics of the above-described substrate.

The invention claimed is:

1. A polishing device for delayering comprising:

a stage which is installed to move along the X-axis and the Y-axis, and is rotatable about its own axis;

a holder installed above the stage and supporting an object seated on an upper surface there of; and a grinder unit installed to be movable above the holder and comprising a main body and a tool unit rotatably installed at a lower portion of the main body, the tool unit including a polishing pad on a lower surface of the tool unit corresponding to the object, wherein the holder comprises:

a rotating plate which includes a seating groove with a depth lower than the height of the object formed on an upper surface thereof, is installed to move along the X-axis and the Y-axis in an installation target area, and is rotatable about its own axis;

a fixing block installed on one side of an inner wall of the rotating plate, and an elastic member configured to elastically press the fixing block toward the object so as to elastically press a side of the object and thereby fix the object when the object is seated in the seating groove of the rotating plate; and a plurality of horizontal correction rings that protrude upward from an upper surface of the rotating plate and form concentric circles with the seating groove.

2. The polishing device for delayering according to claim 1, wherein the main body installed on an upper portion of the holder and configured to be movable in a direction toward or away from the holder, and wherein the tool unit includes a body portion rotatably installed at a lower portion of the main body and the polishing pad coupled to a lower portion of the body portion, the polishing pad being made of a felt material or a fabric material and grinding the object while rotating in contact with the object when the main body approaches the holder.

3. The polishing device for delayering according to claim 1, wherein the holder further comprises a guide wall that extends upward from an outer peripheral area of the rotating plate.

4. The polishing device for delayering according to claim 1, wherein the rotating plate is configured to reciprocate in at least of an X-axis direction and a Y-axis direction, such that the rotating plate is vibrated and rotated at the same time.

* * * * *